United States Patent [19]

Morin et al.

[11] 4,180,266

[45] Dec. 25, 1979

[54] RING TOSS GAME

[76] Inventors: Fernand Morin, c/o George Spector, 3615 Woolworth Bldg., 233 Broadway; George Spector, 3615 Woolworth Bldg., 233 Broadway, both of New York, N.Y. 10007

[21] Appl. No.: 762,314

[22] Filed: Jan. 25, 1977

[51] Int. Cl.[2] ..... A63B 67/06

[52] U.S. Cl. ..... 273/100

[58] Field of Search ..... 273/100, 98, 99, 102 R

[56] References Cited

U.S. PATENT DOCUMENTS

| | | | |
|---|---|---|---|
| 556,246 | 3/1896 | Blackham | 273/100 |
| 1,168,854 | 1/1916 | Chase | 273/100 X |
| 1,523,756 | 1/1925 | Collins | 273/100 |
| 1,595,527 | 8/1926 | Schacht | 273/100 |
| 3,823,942 | 7/1974 | Duncan | 273/100 |

FOREIGN PATENT DOCUMENTS

| | | | |
|---|---|---|---|
| 124719 | of 1949 | Sweden | 273/100 |

*Primary Examiner*—William H. Grieb

[57] ABSTRACT

A ring toss game device that includes a goal unit welded from steel and toward which circular rings are tossed by players; the goal unit including five, score numbered, vertical spikes around which the rings are attempted to be ringed, the spikes being a distance apart so that two of them can possibly get encircled by a single ring.

4 Claims, 5 Drawing Figures

Fig. 1
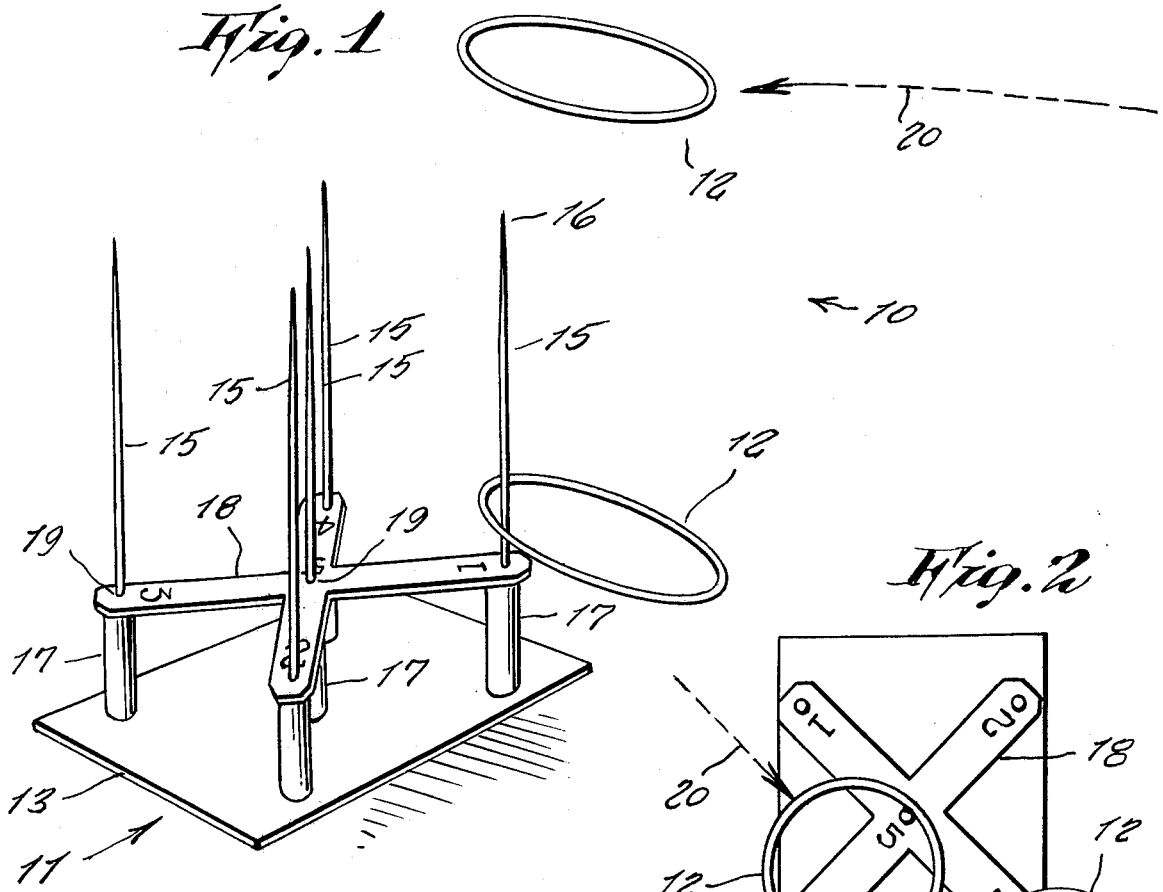
Fig. 2
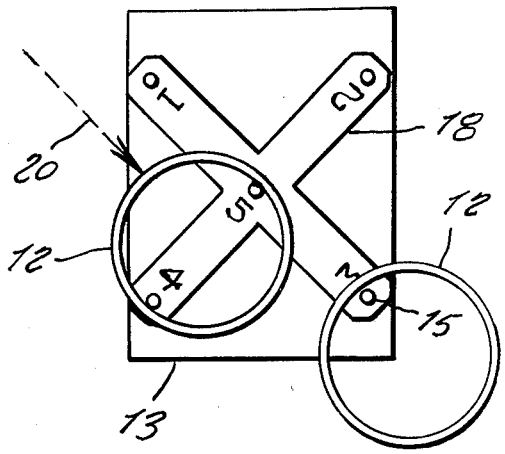
Fig. 4a
Fig. 4b
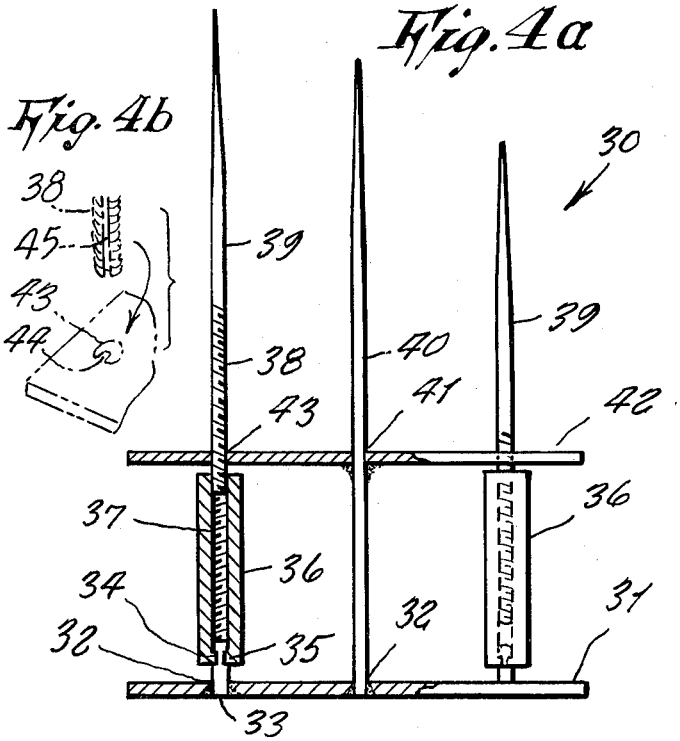
Fig. 5
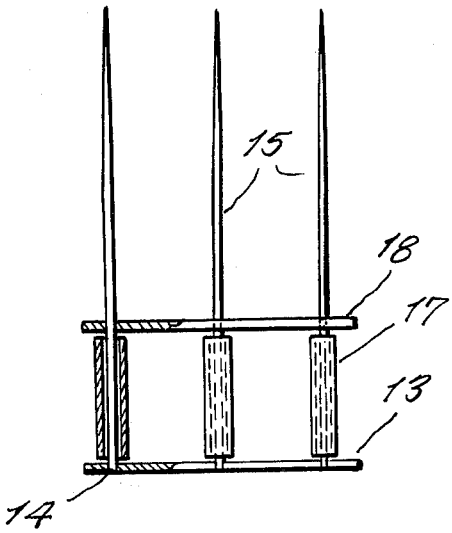

RING TOSS GAME

This invention relates generally to ring toss games.

A principal object of the present invention is to provide a ring toss game having a goal that includes five vertical spikes each of which is score numbered so a tossed ring has a greater possibility of ringing at least one of them and making a score.

Another object is to provide a ring toss game in which the goal spikes are sufficiently close together so that there is a possibility of ringing two of the spikes at a same time so to attain a combined score thereof.

Still another object is to provide a ring toss game in which the goal is made entirely of welded steel.

Still a further object is to provide a ring toss game which in a modified design has spikes that are vertically adjustable in height so to increase or decrease the chances of ringing some of the spikes.

Other objects are to provide a ring toss game which is simple in design, inexpensive to manufacture, rugged in construction, easy to use and efficient in operation.

These and other objects will be readily evident upon a study of the following specification and the accompanying drawing wherein:

FIG. 1 is a perspective view of the ring toss game goal and some of the rings tossed thereto.

FIG. 2 is a top view thereof.

FIG. 3 is a side view thereof shown partly in cross-section.

FIG. 4 is a similar view of a modified design thereof in which the spikes are vertically adjustable in height.

Referring now to the drawing in greater detail, and more particularly to FIGS. 1 to 3 at this time, the reference numeral 10 represents a ring toss game according to the present invention wherein the same includes at least one goal unit 11 and a set of several rings 12.

Both the goal and the rings are made of welded steel.

The goal includes a rectangular base plate 13 having five drilled holes 14 in each of which a lower end of a vertical spike 15 is welded. The spikes are straight, tapering to an upper point 16 and are all a same length.

A sleeve 17 is loosely fitted on each of the spikes for resting upon the base plate.

A cross shaped member 18 has a hole 19 drilled through a center and through each cross arm end so to be fitted on the five spikes. The member 18 is then loosely mounted on the spikes and is positioned resting on the sleeves, allowing enough clearance so the sleeves are free to move a limited amount.

The upper flat surface of the cross shaped member has a different scoring numeral stamped adjacent each of the spikes.

Each of the rings 12 is circular in shape and is round in cross section.

In playing the game, a player located some distance away from the goal, tosses the rings one at a time toward the goal in order to encircle the spikes and thus attain a score. As shown in FIG. 2, the rings are of a size so that with good luck, they can possibly encircle any two of the spikes so to attain a combined score of both. In playing the game, the goal is positioned so that the spike scored with a numeral 1 is closest to a player, so that the tossed rings come from a direction as is indicated by the dotted arrow 20 in FIGS. 1 and 2.

In FIG. 4, a modified design of a goal 30 is shown, in which a rectangular base plate 31 has five holes 32 in four of which stub shafts 33 are welded. Each stub shaft has an annular groove 34 engaging a bead 35 of a sleeve 36 so that the sleeve is free to rotate therearound. The sleeve has a central threaded opening 37 engaging a screw thread 38 along a lower portion of each spike 39.

A center hole 32 of the base plate has a spike 40 welded therein, the spike passing through an opening 41 in a cross shaped member 42 and being welded thereto.

The member 42 has a clearance hole 43 at each cross arm end through which the threaded spikes 39 are freely slidable vertically but are withheld from rotating by means of a lug 44 protruding into the hole 43 engaging a longitudinal straight groove 45 across the thread of the spike Thus by manually turning the sleeve, the spike can be raised or lowered through the cross shaped member, so that the spike upper ends may be made higher or lower respective to each other and to the stationary central spike 40.

Thus in this form of the invention, the game may be made either easier or more difficult for a tossed ring to attain ringing certain of the spikes as wished.

The game may be played either competitively between several players or by a player playing alone.

While various changes may be made in the detail construction, it is understood that such changes will be within the spirit and scope of the present invention, as is defined by the appended claims.

What is claimed is:

1. A ring toss game comprising a base with a flat upper surface having secured thereto and extending at right angles to said base spaced spikes in combination with a member comprising spaced cross arms having holes therethrough adapted to slidably receive said spikes, in further combination with sleeves mounted loosely about each spike and bearing against said surface at a lower end and supporting said member at an upper end, in combination with a plurality of rings of diameter to encompass at least two spikes, whereby said rings will be supported about a spike on said member spaced from the base when tossed thereon.

2. A game as in claim 1, wherein said member is in the shape of a cross having four holes through the end of each arm and a hole at the cross center, said spikes having an alignment corresponding to said holes and said spikes being of varying heights above said base.

3. A game as in claim 1, including means for varying the height of a plurality of said spikes relative to said member.

4. A game as in claim 3, wherein said means comprise affixing one of said spikes to said member and wherein said spikes are each threadedly mounted in said sleeve which is swivelled to a stub secured to the base, including a groove and coacting lug structure on said spikes and said member whereby sleeve rotation causes axial movement of said spikes relative to said member.

* * * * *